United States Patent [19]

Leigh-Monstevens

[11] Patent Number: 4,866,937

[45] Date of Patent: Sep. 19, 1989

[54] DOUBLE-ACTING MASTER-SLAVE CYLINDER SYSTEM WITH VOLUME COMPENSATING CONDUIT

[75] Inventor: Keith V. Leigh-Monstevens, Troy, Mich.

[73] Assignee: Automotive Products, plc, Warwickshire, England

[21] Appl. No.: 195,430

[22] Filed: May 13, 1988

Related U.S. Application Data

[63] Continuation of Ser. No. 36,343, Apr. 9, 1987, abandoned.

[51] Int. Cl.[4] ..... F15B 7/02; F15B 7/10; F15B 21/04

[52] U.S. Cl. ..... 60/572; 92/1

[58] Field of Search ..... 60/571, 572, 583; 92/1

[56] References Cited

U.S. PATENT DOCUMENTS

| | | | |
|---|---|---|---|
| 2,286,661 | 6/1942 | Warner | 92/1 X |
| 2,383,180 | 8/1945 | Ellinwood | 60/572 |
| 2,410,978 | 11/1946 | Kelly | 92/1 X |
| 2,427,591 | 9/1947 | Denison | 92/1 X |
| 2,468,489 | 4/1949 | D'Arcey | 92/1 X |
| 2,607,321 | 8/1952 | Lado | 91/378 X |
| 2,984,983 | 5/1961 | Griffith | 92/1 X |
| 4,024,714 | 5/1977 | Nordin | 60/572 |
| 4,344,287 | 8/1982 | Sindelar | 60/572 |
| 4,633,726 | 1/1987 | Chang | 60/571 |

FOREIGN PATENT DOCUMENTS

| | | | |
|---|---|---|---|
| 1625109 | 2/1978 | Fed. Rep. of Germany | 60/583 |
| 1126502 | 5/1955 | France | 60/571 |
| 956485 | 4/1964 | United Kingdom | 60/571 |

*Primary Examiner*—Robert E. Garrett
*Assistant Examiner*—George Kapsalas
*Attorney, Agent, or Firm*—Krass and Young

[57] ABSTRACT

A hydraulic master and slave cylinder assembly of the type in which a piston is positioned in the master cylinder, a piston rod is connected to the piston and extends out of the input end of the master cylinder, a piston is positioned in the slave cylinder, a piston rod is connected to the slave cylinder piston and extends out of the output end of the slave cylinder, a first conduit extends between the output end of the master cylinder and the input end of the slave cylinder, and a second conduit extends between the input end of the master cylinder and the output end of the slave cylinder. The length of the conduit interconnecting the input end of the master cylinder and the output end of the slave cylinder is greater than the length of the other conduit by an amount compensating for the difference in the full bore volumes of cylinders and the piston rod or annular bore volumes of the cylinders so that the total volume defined on the full bore sides of the cylinders, including the interconnecting conduit, is substantially equal to the total volume defined on the annular sides of the cylinders, including the interconnecting conduit, with the result that creep occurring in the system as a result of extreme temperature variations within the system is substantially eliminated so that the assembly may be used as a remote shift mechanism for a motor vehicle automatic transmission without fear of inadvertently shifting the transmission due to creep occurring in the system in extreme temperature situations.

7 Claims, 1 Drawing Sheet

DOUBLE-ACTING MASTER-SLAVE CYLINDER SYSTEM WITH VOLUME COMPENSATING CONDUIT

This application is a continuation of application Ser. No. 036,343 filed on Apr. 9, 1987, now abandoned.

BACKGROUND OF THE INVENTION

This invention relates to a hydraulic master and slave cylinder assembly and more particularly to such an assembly which is particularly suitable for use in remotely shifting a motor vehicle transmission.

Motor vehicle automatic transmissions are provided with a manual control for selecting the mode of operation of the transmission, for example for shifting from park and/or neutral to reverse or to forward drive, or to prevent automatic shifting from the high gear ratio to a lower gear ratio or to straight through drive, or to overdrive. The manual control or selector takes the form of a steering column mounted pivotal lever, or of a floor mounted lever or quadrant.

The shift control lever or selector conventionally operates, through cables, rods, or links, a mode selection arm pivotally mounted on the transmission casing. The mode selection arm is typically mounted on the end of a control input shaft projecting within the transmission casing and adapted to operate diverse control members within the transmission casing, such as hydraulic valves or solenoids, for functionally establishing an operative mode of the transmission under the control of the shift control or selector lever.

Mechanical control linkages between the shift control or selector lever and the control input arm of the transmission are generally satisfactory but tend to be rather complex in view of the need to tortuously route the various cables, rods and links between the shift control lever and the transmission. In an effort to eliminate the complexity of mechanical shift linkages of this type, it has been proposed to remotely shift the automatic transmission by the use of a hydraulic master and slave cylinder assembly in which the motion of the selector lever is transmitted to the master cylinder and the master cylinder in turn transmits a hydraulic link signal to the slave cylinder which remotely positions the transmission in the desired gear. Master and slave cylinder assemblies of this type are disclosed, for example, in U.S. Pat. Nos. 4,785,615 dated Nov. 22, 1988 and 4,788,821 dated Dec. 6, 1988, both assigned to the assignee of the present application. Whereas hydraulic master and slave cylinder assemblies perform admirably in remotely shifting a motor vehicle automatic transmission, such assemblies are subject to creepage in extreme temperature differential situations and this creepage can actually result in the transmission being inadvertently placed in other than the desired gear or mode. For example, in situations where the master cylinder is located in or adjacent the heated passenger compartment of the motor vehicle, and the slave cylinder is located remotely in the totally unheated area of the motor vehicle, extreme cold weather conditions can produce a situation in which, by virtue of the extreme difference in temperature in which the master and slave cylinders are operating, the output member of the slave cylinder inadvertently creeps relative to the master cylinder to an extent to place the transmission in a mode other than the mode indicated by the selector lever.

Master and slave cylinder assemblies have also been proposed for use with motor vehicle manual transmissions. Such a master and slave assembly suitable for use with a manual transmission is disclosed in U.S. Pat. No. 4,712,640 dated on Dec. 15, 1987 and assigned to the assignee of the present invention. Temperature induced creepage problems can also adversely affect the performance of master and slave cylinder assemblies when used to shift manual transmissions.

SUMMARY OF THE INVENTION

This invention is directed to the provision of a hydraulic master and slave cylinder assembly in which creepage due to temperature differentials within the assembly is substantially eliminated.

More particularly, this invention is directed to the provision of a hydraulic master and slave cylinder assembly for use in remotely shifting a motor vehicle transmission in which creep in the output member of the slave cylinder resulting from temperature differentials within the total assembly is largely eliminated so as to avoid inadvertent shifting of the transmission.

The hydraulic master and slave cylinder assembly of the invention is of the type in which a piston is positioned in the master cylinder; a piston rod is connected to the piston and extends out of the input end of the master cylinder; a piston is positioned in the slave cylinder; a piston rod is connected to the slave cylinder piston and extends out of the output end of the slave cylinder; a first conduit extends between the output end of the master cylinder and the input end of the slave cylinder; and a second conduit extends between the input end of the master cylinder and the output end of the slave cylinder.

According to the invention, the total volume defined by the second conduit, that is the conduit extending between the input of the master cylinder and the output of the slave cylinder, is greater than the total volume defined by the first conduit, that is the conduit extending between the output of the master cylinder and the input of the slave cylinder, in compensation for the lesser areas defined on the piston rod sides of the pistons. This arrangement ensures that extreme temperature variations acting on the master cylinder and slave cylinder will effectively act on equal volumes defined on the full bore and the piston rod side of the piston so that no significant creepage will result.

According to a further feature of the invention, the first and second conduits are of equal cross sectional size but of unequal length. This arrangement provides an inexpensive and convenient means for providing the volume differential between the two conduits while allowing the use of standard conduit material for both conduits.

According to a further feature of the invention, the difference in total volume between the first and second conduits comprises an approximation of the difference in total volume of the piston rod sides of the cylinders and the full bore sides of the cylinders. Approximating the volume differential as between the conduits to the volume differential as between the full bore and piston rod sides of the cylinder ensures that any creep occurring as a result of extreme temperature differentials within the assembly is substantially eliminated.

DETAILED DESCRIPTION OF THE PREFERRED EMBODIMENTS

Figure 1:
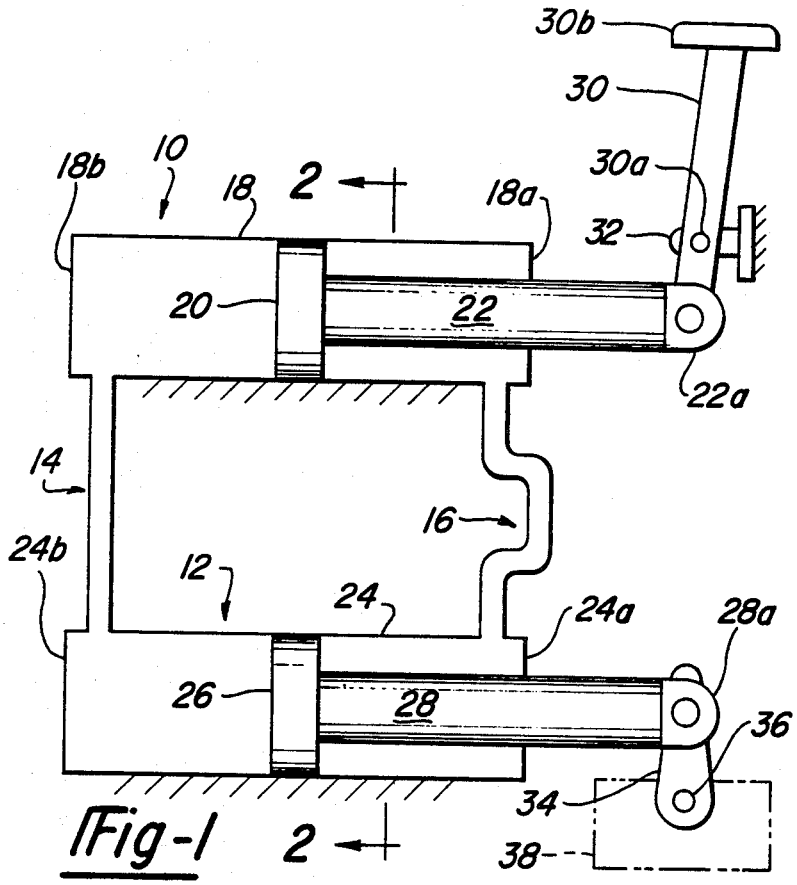
FIG. 1 is a schematic view of a hydraulic master and slave cylinder assembly according to the invention employed as a remote shift mechanism for a motor vehicle automatic transmission.
Figure 2:
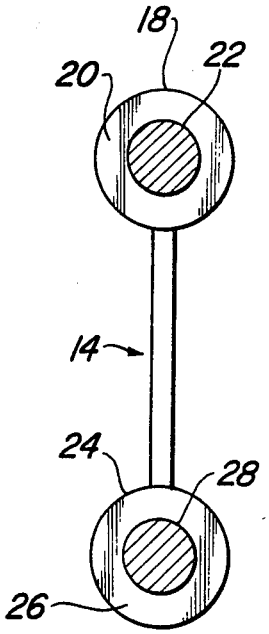
FIG. 2 is a cross-sectional view taken on line 2—2 of FIG. 1.

The hydraulic master and slave cylinder assembly seen in FIGS. 1 and 2 includes a master cylinder assembly 10, a slave cylinder assembly 12, a first conduit 14, and a second conduit 16.

Master cylinder assembly 10 includes a master cylinder 18; a piston 20 slidably positioned within the cylinder, and a piston rod 22 connected at one end thereof to piston 20 and extending out of the input end 18*a* of the cylinder.

Slave cylinder assembly 12 includes a slave cylinder 24; a piston 26 positioned within cylinder 24; and a piston rod 28 connected at one end thereof to piston 26 and extending at its other end out of the output end 24*a* of the cylinder 24.

Conduit 14 comprises any suitable high pressure tubing and extends from the output end 18*b* of master cylinder 18 to the input end 24*b* of slave cylinder 24.

Conduit 16 is also formed of any suitable high pressure tubing and extends from the input end 18*a* of master cylinder 18 to the output end 24*a* of slave cylinder 24.

The invention hydraulic master and slave cylinder assembly is seen in FIG. 1 employed as the remote shift mechanism for an automatic transmission of a motor vehicle. Specifically, piston rod 22 of master cylinder 18 is pivotally connected at its free end 22*a* to the lower end of a selector lever 30 suitably pivotally mounted at 30*a* to a bracket 32 secured to the motor vehicle frame and presenting a handle 30*b* at its upper end for suitable grasping by a driver situated in 5 the driver's compartment of the vehicle. The piston rod 28 of slave cylinder 12 is connected at its free end 28*a* to a transmission mode selector arm 34 secured at its lower end to a transmission mode input shaft 36 projecting from the housing 38 of the automatic transmission of the motor vehicle. It will be understood that, with this arrangement, selective movement of selector lever 30 by the driver of the motor vehicle selectively moves piston 20 within master cylinder 18 and selectively discharges fluid through conduit 14 and into slave cylinder 12 for action on piston 26 to selectively position mode selector arm 34 and selectively position the transmission in the desired mode or gear ratio. Conversely, movement of lever 30 in the opposite direction will move piston 20 in the opposite direction within master cylinder 18 and move slave cylinder piston 26 in the opposite direction within slave cylinder 24 to move mode selector lever 34 in an opposite sense to again selectively condition the transmission in the appropriate mode or gear ratio.

Hydraulic shift assemblies of this type are extremely effective in remotely shifting the automatic transmission of a motor vehicle in that they provide precise and positive movement of the gear mode selector lever in response to movement of the selector lever in the passenger compartment and in that they eliminate the complex cable, rod, and linkage combinations of the prior art mechanical linkage assemblies.

However, hydraulic shift assemblies of this type, in situations where the master cylinder and slave cylinder are subjected to vastly different environmental temperatures, can sometimes operate to produce a creeping movement of the piston of the slave cylinder and thereby a creeping movement of a mode selector lever of a transmission and, in extreme cases, can result in the transmission being placed inadvertently in a mode or gear ratio other than that selected by the gear selector lever. This creepage occurs because the total volume on the full bore sides of the master and slave cylinders differs from the total volume on the piston rod sides of the master and slave cylinders by virtue of the volumes occupied by the piston rods of the master and slave cylinders.

Since the full bore sides of the master and slave cylinders present a significantly larger total volume than the piston rod sides, any differential expansion as between the volumes of the master cylinder and the volumes of the slave cylinder can result in a differential movement of the piston of the slave cyinder since the other elements of the system are precluded from movement. That is, cylinder 18 is precluded from movement by virtue of its rigid mounting to the frame of the motor vehicle; piston 20 and piston rod 22 are precluded from movement by virtue of their rigid connection to selector lever 30, and slave cylinder 24 is prevented from movement by virtue of its rigid mounting to the frame of the motor vehicle. Hence, the only element that is capable of movement in response to differential expansion within the system is the piston and piston rod of the slave cylinder and this creeping movement of the piston and piston rod of the slave cylinder in turn produces inadvertent and undesired movement of the selector mode lever 34 and possible inadvertent shifting of the transmission into an undesired mode.

An extreme scenario, in which the chance of inadvertent shifting would be maximized, would involve a situation in which the master cylinder is mounted in or adjacent the passenger compartment of the motor vehicle and the slave cylinder is mounted remotely from the passenger compartment so that, in extreme cold weather conditions, the hydraulic fluid in the master cylinder might be exposed to a temperature of 70 degrees F. while the hydraulic fluid in the slave cylinder might be exposed to a subzero temperature. In this extreme scenario, a difference in volumes between the full bore sides of the cylinders and the piston rod sides of the cylinders can result in the generation of a linear creep of the piston and piston rod of the slave cylinder of as much as 3 mm. In some situations and in some transmissions, this amount of linear movement is sufficient to place the transmission in a mode or gear ratio that is different from the gear ratio or mode being selected by selector lever 30.

It has been found that this undesirable creep in the slave cylinder can be eliminated by ensuring that the total effective volumes on the full bore sides of the cylinders and on the piston rod sides of the cylinders is essentially equal and, specifically, it has been found that increasing the volume of the conduit interconnecting the input of the master cylinder and the output of the slave cylinder by an amount compensating for the difference in the full bore volumes and the piston rod volumes of the cylinders has the effect of largely eliminating any creep in the system even in extreme temperature situations.

For purposes of illustration, assume that the master and slave cylinders of the assembly of FIGS. 1 and 2 have a diameter of 0.5 inches; that the piston rods of the cylinders have a diameter of 0.25 inches; that the conduits 14 and 16 have respective lengths of L and L+X and comprise tubing having an internal bore diameter of 0.157 inches, and that the piston rod in each case is in a centered position with an equal stroke of 1.0 inches available in each direction. The fluid volumes can be calculated as follows:

| | | |
|---|---|---|
| Full Bore Hydraulic Chamber | | |
| Master Cylinder Volume | $(\pi)(0.25)^2(1.0) =$ | 0.196 in.$^3$ |
| Slave Cylinder Volume | $(\pi)(0.25)^2(1.0) =$ | 0.196 inc.$^3$ |
| Tubing Volume | $(\pi)(0.0785)^2(1.0) =$ | 0.019 L in$^3$ |
| | Total Volume = | 0.392 + 0.019 L in$^3$ |
| Annular Bore Hydraulic Chamber | | |
| Master Cylinder Volume | $(\pi)(0.25)^2 - (\pi)(0.125)^2(10) =$ | 0.147 in.$^3$ |
| Slave Cylinder Volume | $(\pi)(0.25)^2 - (\pi)(0.125)^2(10) =$ | 0.147 in.$^3$ |
| Tubing Volume | $(\pi)(0.0785)^2 =$ | 0.019 (L + X)in.$^3$ |
| | Total Volume = | 0.294 + 0.019 (L + X)in$^3$ |

Equating the two volume expressions $0.392 + 0.019\,L = 0.294 + 0.019\,(L + X)$
$0.098 = 0.019\,L + 0.019X - 0.019\,L$
$0.098 = 0.019$
$X = 5.16$ in That is, in the assembly illustrated in FIGS. 1 and 2, by making the conduit 16 5.16 inches longer than the conduit 14, the effective volumes on the full bore and on the annular sides of the pistons, including the respective volumes of the interconnecting conduits, will be substantially equal and the creep problems previously described will be substantially eliminated. In tests run with the conduit volumes differentiated to an extent to equate the full bore and annular volumes of the system, creep of the piston and piston rod of the slave cylinder was reduced by at least 90% as compared to the creep occurring under similar conditions with an assembly in which the conduits were of equal length and of equal volume.

Figure 3:
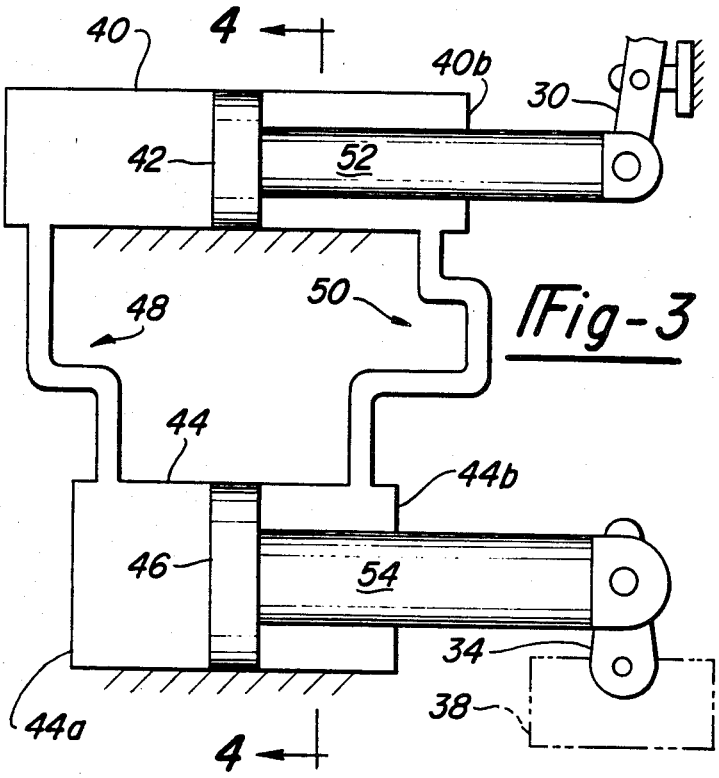
FIG. 3 is a schematic view of a modified form of hydraulic master and slave cylinder assembly according to the invention also shown employed as a remote shift mechanism for a motor vehicle automatic transmission.
Figure 4:
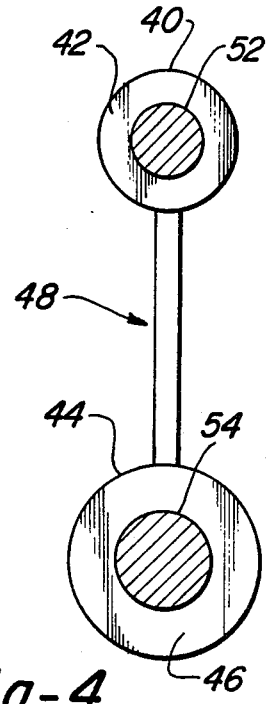
FIG. 4 is a cross-sectional view taken on line 4—4 of FIG. 3.

A further example of the invention is illustrated in the embodiment of FIGS. 3 and 4 in which the hydraulic assembly includes a relatively small diameter master cylinder 40 having a piston 42, a relatively large diameter slave cylinder 44 having a piston 46, a first conduit 48 interconnecting the output end 40*a* of cylinder 40 and the input end 44*a* of cylinder 44, and a second conduit 50 interconnecting the input end 40*b* of cylinder 40 and the output end 44*b* of cylinder 44.

Specifically, assume that master cylinder 40 has a diameter of 0.5 inches; that the master cylinder piston rod 52 has a diameter of 0.25 inches; that slave cylinder 44 has a diameter of 0.706 inches; that the slave cylinder piston rod 54 has a diameter of 0.35 inches; that the conduits 48 and 50 have respective lengths of L and L+Y and comprise tubing having an internal bore diameter of 0.157 inches; and that the pistons are centered in the respective cylinders. These respective master and slave cylinder dimensions are chosen to provide a hydraulic ratio of 2.0:1 as between the master and slave cylinder so that for an assumed one inch stroke in either direction of the master cylinder piston the slave cylinder piston will have a ½ in. stroke in either direction. The fluid volumes can be calculated as follows:

| | | |
|---|---|---|
| Full Bore Hydraulic Chamber | | |
| Master Cylinder Volume | $(\pi)(0.25)^2(1.0) =$ | 0.196 in.$^3$ |
| Slave Cylinder Volume | $(\pi)(0.353)^2(0.5) =$ | 0.196 in.$^3$ |
| Tubing Volume | $(\pi)(0.0785)^2 =$ | 0.019 L |
| | Total Volume = | 0.392 + 0.019L |
| Annular Bore Hydraulic Chamber | | |
| Master Cylinder Volume | $(\pi)(0.25)^2 - (\pi)(0.125)^2(1.0) =$ | 0.147 in.$^3$ |
| Slave Cylinder Volume | $(\pi)(0.353)^2 - (\pi)(0.175)^2(0.5) =$ | 0.147 in.$^3$ |
| Tubing Volume | $(\pi)(0.0785)^2 =$ | 0.019 (L + Y)in.$^3$ |
| | Total Volume = | 0.294 + 0.019(L + Y)in$^3$ |

Equating the two volume expressions $0.392 + 0.019\,L = 0.294 + 0.019\,(L + Y)$
$0.098 = 0.019Y$
$Y = 5.16$ in Thus, in order to equate the effective volumes on the full bore sides of the cylinder, including the interconnecting conduit, with the volume on the piston rod sides of the cylinders, including the interconnecting conduit, it is necessary to again make the conduit interconnecting the input end of the master cylinder and the output end of the slave cylinder 5.16 inches longer than the conduit connecting the output end of the master cylinder with the input end of the slave cylinder. Again, experiments have shown that thus equating the full bore and annular bore volumes of the system has the effect of reducing creep in the system under comparable conditions by at least 90% with the result that inadvertent or unintentional shifting of the transmission is eliminated for all practical considerations.

The invention will be seen to provide a hydraulic shift mechanism for use with a motor vehicle automatic transmission in which all of the inherent advantages of a hydraulic shift mechanism are retained and in which the creep that has plagued prior art hydraulic shift mechanisms of this type is substantially eliminated so that the hydraulic shift mechanism may be utilized even in extreme temperature situations without fear of inadvertent shifting of the transmission.

Whereas preferred embodiments of the invention have been illustrated and described in detail it will be understood that various changes may be made in the disclosed embodiments without departing from the scope or spirit of the invention. For example, although the invention hydraulic shift mechanism has been illustrated and described for use with an automatic transmission, it will be apparent that the invention hydraulic shift mechanism may also be effectively used with a manual transmission.

I claim:

1. In a hydraulic master and slave cylinder assembly of the type in which the master cylinder has an input end and an output end, a piston is positioned in the master cylinder, a piston rod is connected to the piston and extends out of the input end of the master cylinder to define a piston rod side of said master cylinder and a full bore side of said master cylinder, the slave cylinder has an input end and an output end, a piston is positioned in the slave cylinder, a piston rod is connected to the slave cylinder piston and extends out of the output end of the slave cylinder to define a piston rod side of said slave cylinder and a full bore side of said slave cylinder, a first conduit extends between the output end of the master cylinder and the input end of the slave cylinder, and a second conduit extends between the input end of the master cylinder and the output end of the slave cylinder, the improvement wherein, in compensation for the lesser volumes defined on the piston rod sides of said cylinders:

(A) the total volume defined by said second conduit is greater than the total volume defined by said first conduit by an amount that comprises an approximation of the difference in total volume of the piston rod sides of said cylinders and the full bore sides of said cylinders.

2. A hydraulic master and slave cylinder assembly according to claim I wherein:

(B) said first and second conduits are of equal cross section but of unequal length.

3. A hydraulic master and slave cylinder assembly comprising:

(A) a master cylinder assembly including a master cylinder having an input end and an output end, a piston slidably positioned in said master cylinder, and a piston rod connected to said piston and extending out of the input end of said master cylinder to define a piston rod side of said master cylinder and a full bore side of said master cylinder;

(B) a slave cylinder assembly including a slave cylinder having an input end and an output end, a piston slidably positioned in said slave cylinder, and a piston rod connected to said slave cylinder piston and extending out of the output end of said slave cylinder to define a piston rod side of said slave cylinder and a full bore side of said slave cylinder;

(C) a first conduit hydraulically interconnecting the output end of said master cylinder and the input end of said slave cylinder; and (D) a second conduit hydraulically interconnecting the input end of said master cylinder and the output end of said slave cylinder and defining an internal fluid volume exceeding the internal fluid volume defined by said first conduit by an amount that comprises an approximation of the difference in total volume of the piston rod sides of said cylinders and the full bore sides of said cylinder.

4. A hydraulic master and slave cylinder assembly according to claim 3 wherein:

(E) said conduits are of equal cross sectional size; and (F) said second conduit is longer than said first conduit by an amount to compensate for the difference in total volumes of the piston rod sides of said cylinders and the full bore sides of said cylinders.

5. A method of minimizing creep occurring in a hydraulic master and slave cylinder assembly of the type in which the master cylinder has an input end and an output end, a piston is positioned in the master cylinder, a piston rod is connected to the piston and extends out of the input end of the master cylinder to define a piston rod side of said master cylinder and a full more side of said master cylinder, the slave cylinder has an input end and an output end, a piston is positioned in the slave cylinder, a piston rod is connected to the lave cylinder piston and extends out of the output end of the slave cylinder to define a piston rod side of said slave cylinder and a full bore side of said slave cylinder, a first conduit extends between the output end of the master cylinder and the input end of the slave cylinder, and a second conduit extends between the input end of the master cylinder and the output end of the slave cylinder, said method comprising:

(A) configuring said conduits so that said second conduit defines an internal volume that exceeds the internal volume defined by said first conduit by an amount that approximates the difference in total volumes of the piston rod sides of said cylinders and the full bore sides of said cylinders.

6. A method according to claim 5, wherein:

(B) said configuring step comprises forming said conduits of equal cross section but of unequal length.

7. A transmission control system for a motor vehicle of the type including a passenger compartment, a transmission shift control lever positioned in the passenger compartment, and a transmission located remotely from the passenger compartment and including a mode select lever, said control system including (A) a master cylinder arranged to be positioned adjacent the vehicle passenger compartment and including an input end and an output end, a piston positioned in the master cylinder, and a piston rod connected to the piston and extending out of the input end of the master cylinder for connection to the transmission shift control lever and defining a piston rod side of the master cylinder and a full bore side of the master cylinder;

(B) a slave cylinder adapted to be positioned adjacent the transmission and including an input end and an output end, a piston positioned in the slave cylinder, and a piston rod connected to the slave cylinder piston and extending out of the input end of the slave cylinder for connection to the transmission mode select lever and defining a piston rod side of the slave cylinder and a full bore side of the slave cylinder;

(C) a first conduit hydraulically interconnecting the output end of the master cylinder and the input of the slave cylinder; and (D) a second conduit hydraulically interconnecting the input end of the master cylinder and the output end of the slave cylinder and defining an internal fluid volume exceeding the internal fluid volume defined by the first conduit by an amount that comprises an approximation of the difference in total volume of the piston rod sides of the cylinders and the full bore sides of the cylinders.

* * * * *